US009671813B2

(12) United States Patent
Hozumi et al.

(10) Patent No.: US 9,671,813 B2
(45) Date of Patent: Jun. 6, 2017

(54) TRIGGER SWITCH

(75) Inventors: Akihiro Hozumi, Okayama (JP); Yoshiyuki Baba, Hikone (JP); Jiro Suzuki, Anjo (JP); Junichi Nishikimi, Anjo (JP)

(73) Assignees: OMRON Corporation, Kyoto (JP); Makita Corporation, Aichi (JP)

( * ) Notice: Subject to any disclaimer, the term of this patent is extended or adjusted under 35 U.S.C. 154(b) by 342 days.

(21) Appl. No.: 14/239,731

(22) PCT Filed: Jul. 20, 2012

(86) PCT No.: PCT/JP2012/068487
§ 371 (c)(1),
(2), (4) Date: Feb. 19, 2014

(87) PCT Pub. No.: WO2013/035446
PCT Pub. Date: Mar. 14, 2013

(65) Prior Publication Data

US 2014/0202277 A1 Jul. 24, 2014

(30) Foreign Application Priority Data

Sep. 6, 2011 (JP) ..... 2011-194243

(51) Int. Cl.
*G05G 1/02* (2006.01)
*H01H 13/06* (2006.01)

(52) U.S. Cl.
CPC ..... *G05G 1/025* (2013.01); *H01H 13/06* (2013.01); *H01H 13/063* (2013.01); *Y10T 74/20468* (2015.01)

(58) Field of Classification Search
CPC ... Y10T 74/20468; G05G 1/025; H01H 13/06
(Continued)

(56) References Cited

U.S. PATENT DOCUMENTS 3,042,764 A * 7/1962 Hermle ..... H01H 13/06 200/302.2
3,184,574 A * 5/1965 Dennison ..... H01H 13/04 200/302.2
(Continued)

FOREIGN PATENT DOCUMENTS

DE 4128778 A1 * 3/1993
EP 2346056 A2 7/2011
(Continued)

OTHER PUBLICATIONS

EPO Abstract of JP 2007287560, Yasuhiko, Nov. 2007.*
(Continued)

*Primary Examiner* — Vinh Luong
(74) *Attorney, Agent, or Firm* — Osha Liang LLP

(57) ABSTRACT

A trigger switch has a case member, a cover member, and an operation member configured to be used to carry out an operation. The case member and the cover member are combined with each other to form a waterproof case. When the operation member is operated, the operation member is displaced inward of the waterproof case. An internal pressure of the waterproof case changes in accordance with displacement of the operation member. The case member has a case base that is made from an inelastic body. The case base does not deform in accordance with a change in internal pressure of the waterproof case. The case base has at least one hole part. The case member has at least one deformation section that seals the at least one hole part. The deformation section is made from an elastic body.

4 Claims, 5 Drawing Sheets

(58) Field of Classification Search
USPC ..... 200/302.01, 302.02
See application file for complete search history.

(56) References Cited

U.S. PATENT DOCUMENTS

| | | | | |
|---|---|---|---|---|
| 4,339,634 | A * | 7/1982 | Weber | H01H 13/06 200/302.2 |
| 7,420,136 | B2 * | 9/2008 | Goetzl | H01H 13/06 200/302.2 |
| 8,748,766 | B2 * | 6/2014 | Han | H01H 13/06 200/302.1 |
| 2003/0128397 | A1 | 7/2003 | Smith et al. | |
| 2005/0029085 | A1 | 2/2005 | Dozono et al. | |
| 2010/0001152 | A1 * | 1/2010 | Golle | F16B 5/0642 248/220.21 |
| 2010/0175975 | A1 * | 7/2010 | Yltchev | H01H 13/06 200/406 |
| 2011/0168420 | A1 * | 7/2011 | Kobayashi | H01H 13/06 173/170 |
| 2014/0046378 | A1 * | 2/2014 | Waizenegger | A61B 17/68 606/302 |
| 2014/0054919 | A1 * | 2/2014 | Oeuvrard | B60K 37/06 296/70 |
| 2014/0252883 | A1 * | 9/2014 | Dinh | H01H 13/06 307/125 |
| 2015/0201723 | A1 * | 7/2015 | Rayner | G06F 1/1601 224/191 |

FOREIGN PATENT DOCUMENTS

| | | | | |
|---|---|---|---|---|
| JP | 5-11243 | U | 2/1993 | |
| JP | 07-25525 | U | 5/1995 | |
| JP | 07-314580 | A | 12/1995 | |
| JP | 11-243283 | A | 9/1999 | |
| JP | 2001-110271 | A | 4/2001 | |
| JP | 2002-75110 | A | 3/2002 | |
| JP | 2003-228112 | A | 8/2003 | |
| JP | 2005-56695 | A | 3/2005 | |
| JP | 2005-203290 | * | 7/2005 | |
| JP | 2005-310979 | A | 11/2005 | |
| JP | 2007-194127 | A | 8/2007 | |
| JP | 2007-287560 | * | 11/2007 | G05G 1/025 |
| JP | 2008-172743 | A | 7/2008 | |

OTHER PUBLICATIONS

Define thermoplastic elastomer—Google Search, Mar. 21, 2016.*
Thermoplastic elastomer, en.wikipedia.org, Mar. 21, 2016.*
EPO Machine Translation of JP 07-314580, Yoshiaki, Dec. 1995.*
EPO Machine Translation of DE 4128778 A1, Josef et al., Mar. 1993.*
EPO Machine Translation of JP 2005-203290, Jun. 7, 2005.*
Define diameter, google.com., Aug. 24, 2016.*
Elastic metal—Google Search, google.com., Dec. 3, 2016.*
Define elastic—Google Search, google.com., Dec. 5, 2016.*
International Search Report for corresponding International Application No. PCT/JP2012/068487, mailed Sep. 11, 2012 (4 pages).
Written Opinion for corresponding International Application No. PCT/JP2012/068487, mailed Sep. 11, 2012 (4 pages).
International Preliminary Report on Patentability issued in corresponding International Application No. PCT/JP2012/068487 issued Mar. 12, 2014 (6 pages).
Extended European Search Report issued in corresponding European Application No. 12830862.4, mailed on May 15, 2015 (8 pages).
Office Action issued in corresponding Japanese Application No. 2011-194243, mailed on Aug. 18, 2015 (5 pages).

* cited by examiner

TRIGGER SWITCH

BACKGROUND

Technical Field

The present invention relates to a trigger switch.

Related Art

Conventionally, there has been a trigger switch which includes (i) a waterproof case including a switch and (ii) an operation section which is used to carry out an operation with respect to the switch. The switch is turned ON or OFF by, for example, pushing the operation section inward the waterproof case. For example, Patent Literature 1 discloses a typical trigger switch.

An internal pressure of the waterproof case having airtightness changes in accordance with an operation stroke of pushing the operation section inward the waterproof case. Note that a small-sized waterproof case has a narrow inner space due to a component(s) which is included therein. This will cause a great change in internal pressure of the small-sized waterproof case. Such a change in internal pressure of the waterproof case will affect (i) waterproofness and dustproofness of the waterproof case and (ii) an operation of pushing the operation section inward the waterproof case.

Japanese Patent Application Publication, Tokukai, No. 2001-110271 A (Publication Date: Apr. 20, 2001)

SUMMARY

However, an operation of such a conventional trigger switch will adversely affect waterproofness and dustproofness of a waterproof case of the trigger switch.

In order to secure waterproofness of a waterproof case which includes a switch, a sealing member such as a gasket or packing is provided, for example, (i) between combined parts of the waterproof case and (ii) between the waterproof case and an operation section. This allows the waterproof case to have airtightness in addition to the waterproofness.

An internal pressure of the waterproof case having such airtightness changes in accordance with an operation stroke of pushing the operation section inward the waterproof case (or an operation stroke of pulling the operation section outward the waterproof case). Note that a small-sized waterproof case has a narrow inner space due to a component(s) which is included therein. This will cause a great change in internal pressure of the small-sized waterproof case. Such a change in internal pressure of the waterproof case will affect waterproofness and dustproofness of the waterproof case. For example, a drop(s) of water on the combined parts of the waterproof case may be sucked into the waterproof case by pulling the operation section outward the waterproof case.

One or more embodiments of the present invention provides a trigger switch capable of securing waterproofness.

A trigger switch according to one or more embodiments of the present invention is configured to include: a case member; a cover member; and an operation section which is used to carry out an operation, the case member and the cover member being combined with each other so as to constitute a waterproof case, the operation section being able to be operated so as to be displaced inward the waterproof case, an internal pressure of the waterproof case changing in accordance with the operation section being displaced, the case member including a case base which (i) is made from an inelastic body and (ii) does not deform in accordance with a change in internal pressure of the waterproof case, the case base having at least one (1) hole part, and the case base including at least one (1) deformation section which (i) seals the at least one hole part, (ii) is made from an elastic body, and (iii) deforms in accordance with the change in internal pressure of the waterproof case.

According to the configuration, since the case base is made from the inelastic body, the case base does not deform in accordance with the change in internal pressure of the waterproof case. In contrast, since the at least one deformation section is made from the elastic body, the at least one deformation section deforms in accordance with the change in internal pressure of the waterproof case. It is therefore possible to adjust the change in internal pressure of the waterproof case by causing the at least one deformation section to deform in accordance with the operation section being displaced. This prevents waterproofness from being deteriorated by the change in internal pressure of the waterproof case.

A trigger switch according to one or more embodiments of the present invention is configured to include: a case member; a cover member; and an operation section which is used to carry out an operation, the case member and the cover member being combined with each other so as to constitute a waterproof case, the operation section being able to be operated so as to be displaced inward the waterproof case, an internal pressure of the waterproof case changing in accordance with the operation section being displaced, the case member including a case base which (i) is made from an inelastic body and (ii) does not deform in accordance with a change in internal pressure of the waterproof case, the case base having at least one (1) hole part, and the case base including at least one (1) deformation section which (i) seals the at least one hole part, (ii) is made from an elastic body, and (iii) deforms in accordance with the change in internal pressure of the waterproof case.

It is therefore possible to adjust the change in internal pressure of the waterproof case by causing the at least one deformation section to deform in accordance with the operation section being displaced. This prevents waterproofness from being deteriorated by the change in internal pressure of the waterproof case.

DETAILED DESCRIPTION

The following description will discuss in detail embodiments of the present invention with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

<Structure of Waterproof Switch>

Figure 1:
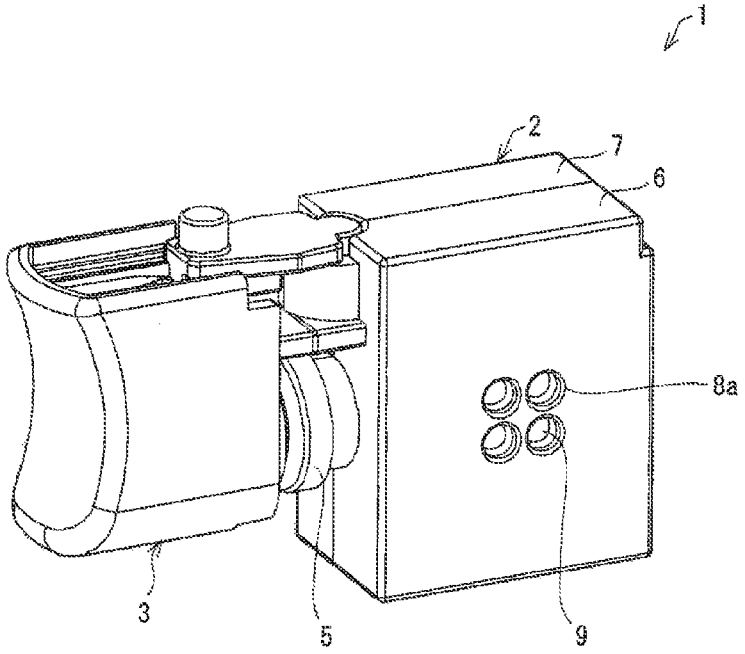
FIG. 1 is a perspective view schematically illustrating a configuration of a waterproof switch in accordance with one or more embodiments of the present invention.
Figure 2:
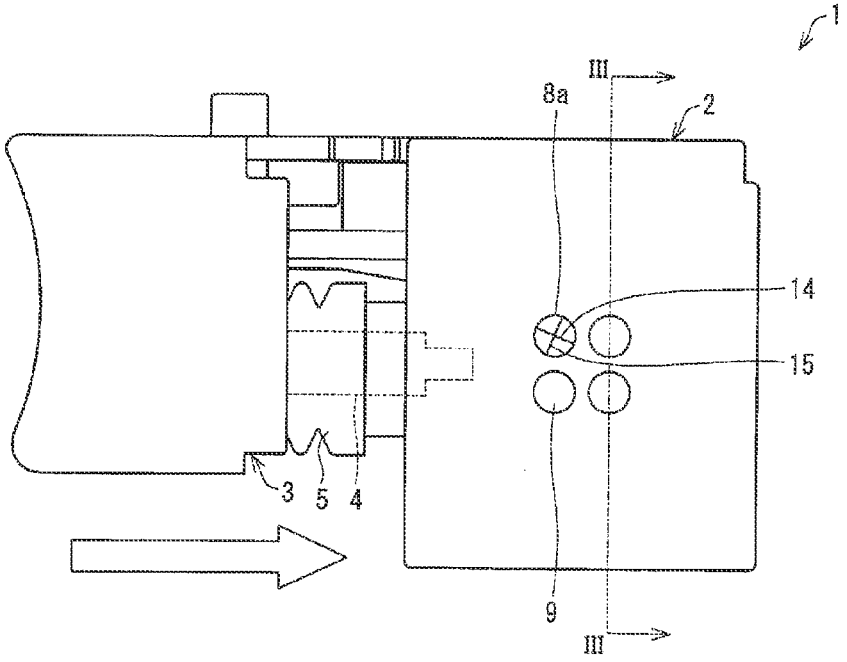
FIG. 2 is an elevation view schematically illustrating the configuration of the waterproof switch.

FIG. 1 is a perspective view schematically illustrating a configuration of a waterproof switch (trigger switch) 1 according to one or more embodiments of the present invention. FIG. 2 is an elevation view schematically illustrating the configuration of the waterproof switch 1 according to one or more embodiments of the present invention. The waterproof switch 1 includes a waterproof case 2 and an operation section 3. The waterproof case 2 includes a switch and a wiring substrate that is connected to the switch. The switch is turned ON or OFF via the operation section 3, from outside of the waterproof case 2.

The operation section 3, provided on a side of the waterproof case 2, includes an insertion section 4. Note that FIG. 2 illustrates the insertion section 4 in a perspective manner. The insertion section 4 can be displaced inward the waterproof case 2. In a case where the operation section 3 is operated by a user so as to be pushed toward the waterproof case 2, the insertion section 4 is pushed inward the waterproof case 2. Note that the insertion section 4 is covered by a seal boot 5 having bellows shape so as to secure waterproofness. Note also that a sealing member such as packing or a gasket secures waterproofness and airtightness of parts where the insertion section 4 and other component(s) such as wires are inserted into the waterproof case 2.

The waterproof case 2 is constituted by combining a plurality of case members. According to one or more embodiments of the present invention, the waterproof case 2 includes a case component 6 and a cover component 7 as case members. Note that the case component 6 and the cover component 7 are called differently just because it is easy to distinguish from one from the other. Therefore, a case component and a cover component can have reference numerals 7 and 6, respectively.

Figure 3:
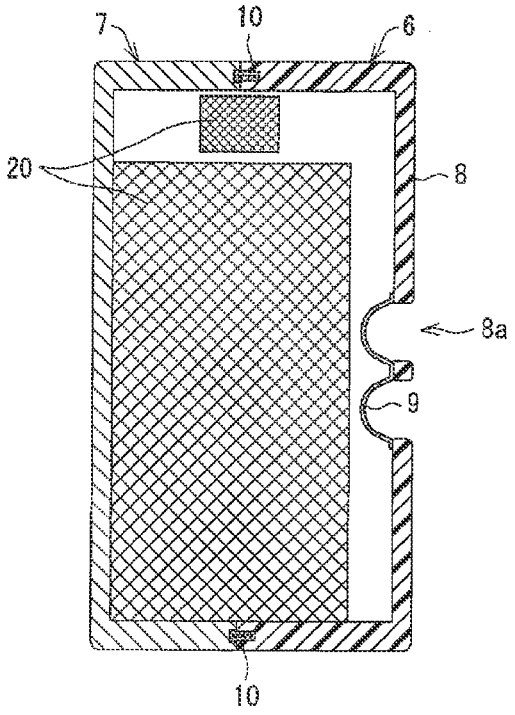
FIG. 3 is a cross-sectional view illustrating a cross section taken along III-III line illustrated in FIG. 2.
Figure 4:
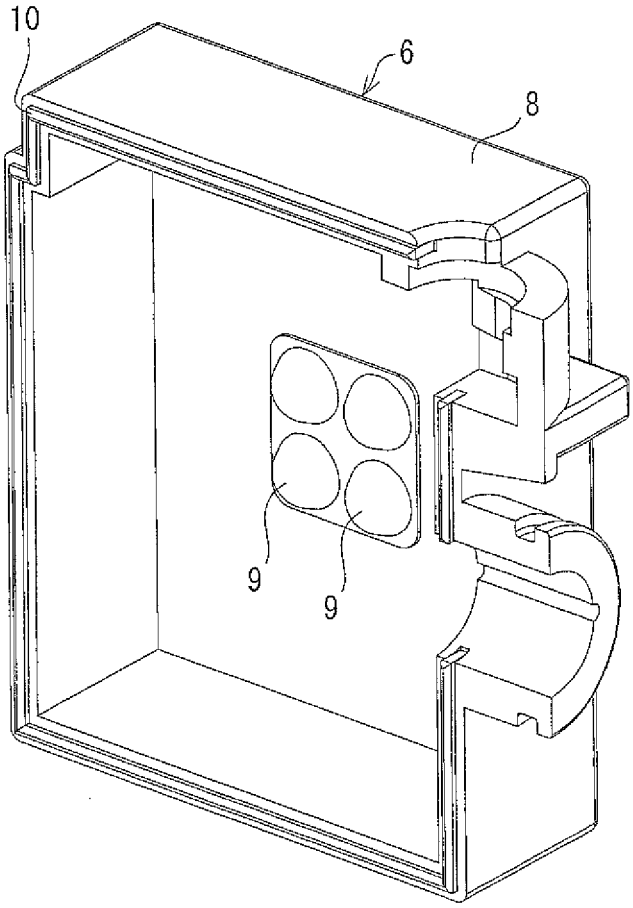
FIG. 4 is a perspective view schematically illustrating a configuration of a case component.

FIG. 3 is a cross-sectional view illustrating a cross section taken along III-III line illustrated in FIG. 2. Note that FIG. 3 illustrates, in a simplified manner, components 20 such as the switch which are included in the waterproof case 2. FIG. 4 is a perspective view schematically illustrating a configuration of the case component 6. The case component 6 includes (i) a case base 8 in a rectangular parallelepiped shape having an opening whose shape corresponds to one (1) surface, (ii) at least one internal pressure adjusting section (deformation section) 9 (four internal pressure adjusting sections 9 in one or more embodiments of the present invention) and (iii) a sealing member 10.

The case base 8 is made from an inelastic body which is hard enough not to deform due to a change in internal pressure of the waterproof case 2. According to one or more embodiments of the present invention, the case base 8 is obtained by molding polybutylene terephthalate (PBT). The case base 8 has a surface in which four hole parts 8*a* (through-holes) are formed, which surface faces the cover component 7 (see FIGS. 1 through 3). Each of the hole parts 8*a* has a diameter of 3 mm.

Each of the four internal pressure adjusting sections 9 is a semispherical film whose diameter is approximately 3 mm. The four internal pressure adjusting sections 9 are formed so as to seal the respective hole parts 8*a* of the case base 8. The internal pressure adjusting sections 9 are made from an elastic body which is soft enough to deform in accordance with the change in internal pressure of the waterproof case 2. According to one or more embodiments of the present invention, the internal pressure adjusting sections 9 are each obtained by molding thermoplastic elastomer, more specifically is obtained by molding polyester elastomer. Therefore, in a case where the internal pressure of the waterproof case 2 is increased by the operation section 3 being pushed inward the waterproof case 2, each of the internal pressure adjusting sections 9 deforms so as to swell outside of the waterproof case 2. As such, it is possible to adjust the internal pressure of the waterproof case 2 by increasing the volume of the waterproof case 2. The internal pressure adjusting sections 9 are each being double-molded so as to be integrated with the case base 8. The four internal pressure adjusting sections 9 can be integral with each other, as illustrated in FIG. 4. Alternatively, the four internal pressure adjusting sections 9 can be separated from each other.

The sealing member 10 is provided in a part of the case base 8, via which part the case component 6 and the cover component 7 are combined with each other. The sealing member 10 thus seals a gap between the case component 6 and the cover component 7. The sealing member 10 is made from an elastic body. According to one or more embodiments of the present invention, the sealing member 10 is made from polyester elastomer which is identical to the material from which the internal pressure adjusting sections 9 are made. The sealing member 10 is double-molded so as to be integrated with the case base 8. In a case where the case component 6 and the cover component 7 are combined with each other, the sealing member 10 comes into contact with the cover component 7, and is deformed by a pressure applied to the sealing member 10. This causes the sealing member 10 to seal the gap.

The case component 6 thus includes (i) the case base 8 made from the inelastic body, (ii) the internal pressure adjusting sections 9 made from the elastic body and (iii) the sealing member 10 made from the elastic body (see FIG. 4). The case base 8, the internal pressure adjusting sections 9, and the sealing member 10 are integrated with each other by means of double-molding. The case base 8, made from the inelastic body, (i) secures a space which accommodates the components of the waterproof case 2 and (ii) protects the components of the waterproof case 2. The internal pressure adjusting sections 9 and the sealing member 10, each made from thermoplastic elastomer, are molded so as to be visible from an identical direction (from an opening side of the case base 8, in other words, from a side where the cover component 7 is to be provided). It is therefore possible to simultaneously mold the internal pressure adjusting sections 9 and the sealing member 10 on the case base 8 which has been already molded. Since the case component 6 thus includes the internal pressure adjusting sections 9 and the sealing member 10, the number of components to be managed is reduced. This allows an easy management of the components. Furthermore, it is unnecessary to combine internal pressure adjusting sections 9 and a sealing member 10 with the case base 8 during assembling of the waterproof case 2. It is therefore possible to reduce the number of steps in assembling the waterproof case 2. The internal pressure adjusting sections 9 can adjust the internal pressure of the waterproof case 2 by absorbing a change in internal pressure of the waterproof case 2, which change is caused by (i) pushing of the operation section 3 inward the waterproof case 2 or (ii) pulling of the operation section 3 outward the waterproof case 2. This allows a reduction in influence exerted by the change in internal pressure of the waterproof case 2. It is therefore possible to prevent a drop(s) of water etc. on the gap between a case member and a cover member from being sucked into the gap by, for example, pulling the operation section outward the waterproof case. The internal pressure adjusting sections 9 can also absorb a change in internal pressure of the waterproof case 2, which change is caused by, for example, an increase in temperature. It is therefore possible to prevent waterproofness of the waterproof case 2 from being deteriorated by the change in internal pressure of the waterproof case 2 due to such an increase in temperature.

According to the waterproof case 2, the plurality of internal pressure adjusting sections 9 are provided in the respective plurality of hole parts 8*a*. By providing the plurality of internal pressure adjusting sections 9, it is possible to reduce the size of each of the internal pressure adjusting sections 9 while allowing the internal pressure adjusting sections 9 to maintain ability to adjust the internal pressure of the waterproof case 2. Note that, since the internal pressure adjusting sections 9 are each made from the elastic body which is relatively soft, the internal pressure adjusting sections 9 are each likely to be damaged by a finger, a tool, or the like. However, such a reduction in size of each of the internal pressure adjusting sections 9 makes it difficult to damage the internal pressure adjusting sections 9 by a finger etc. By causing each of the internal pressure adjusting sections 9 to be formed so as to be dented from the surface of the case base 8, it is possible to make it further difficult to damage the internal pressure adjusting sections 9. Specifically, in order to make it difficult to damage the internal pressure adjusting sections 9 by a finger etc., according to one or more embodiments of the present invention, a size, by which each of the internal pressure adjusting sections 9 is exposed (that is, the diameter of each of the hole parts 8*a* which are formed in the surface of the case base 8), falls within a range from 1 mm to 5 mm.

For example, in a case where each of the hole parts 8*a* is in a rectangular shape, it is preferable that each of the hole parts 8*a* has (i) a long side (first diameter) 14 of not more than 5 mm and (ii) a short side (second diameter) 15 of not less than 1 mm. Note that neither the shape of each of the hole parts 8a nor the shape of each of the internal pressure adjusting sections 9 which seal the respective hole parts 8*a* is limited to a specific shape.

<Process of Producing Case Component>

Figure 5:
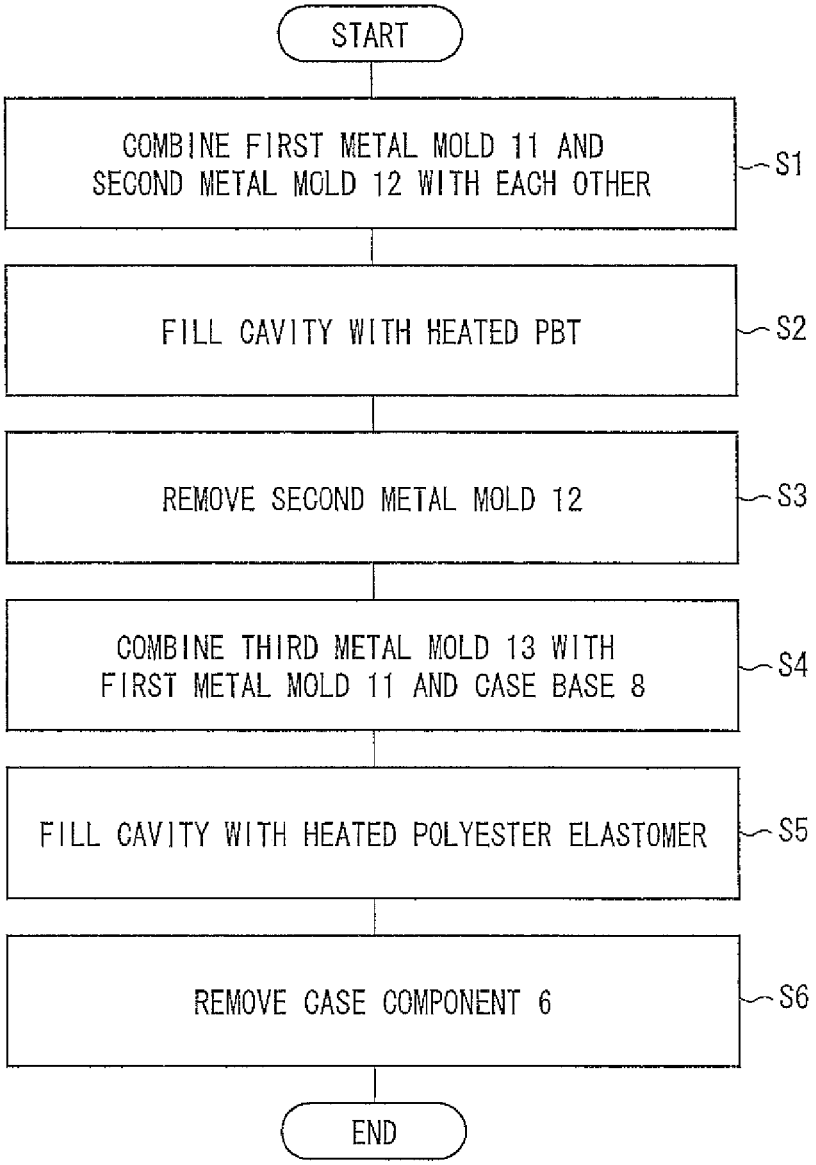
FIG. 5 is a flowchart illustrating a process of producing the case component.

A process of producing a case component 6 includes (i) a first molding step of molding a case base 8 and (ii) a second molding step of molding internal pressure adjusting sections 9 and a sealing member 10 so that they are integrated with the case base 8. FIG. 5 is a flowchart illustrating the process of producing the case component 6.

Figure 6:
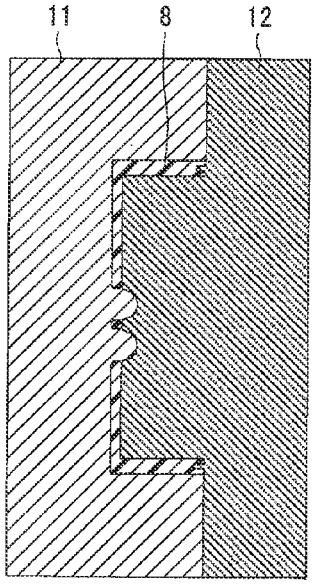
FIG. 6 is a cross-sectional view illustrating how metal molds for injection-molding a case base are arranged in a first molding step.

FIG. 6 is a cross-sectional view illustrating how metal molds for injection-molding the case base 8 are arranged in the first molding step. Specifically, FIG. 6 illustrates a cross section of a location where hole parts are formed in the case base 8 (that is, a location where the internal pressure adjusting sections 9 are formed).

In the first molding step, a first metal mold 11 in a concave shape and a second metal mold 12 in a convex shape are combined with each other (S1). The first metal mold 11 and the second metal mold 12 thus combined define the shape of the case base 8. A cavity between the first metal mold 11 and the second metal mold 12 thus combined is filled with heated PBT (S2). This causes the case base 8, made from inelastic PBT, to be molded. Note that, in so doing, the second metal mold 12 occupies a space where the internal pressure adjusting sections 9 and the sealing member 10 are to be molded.

The second metal mold 12 is then separated from the first metal mold 11 (S3) while the case base 8 thus molded is being adhered to the first metal mold 11.

A third metal mold 13 is combined with the first metal mold 11 and the case base 8 which is being adhered to the first metal mold 11 (S4).

Figure 7:
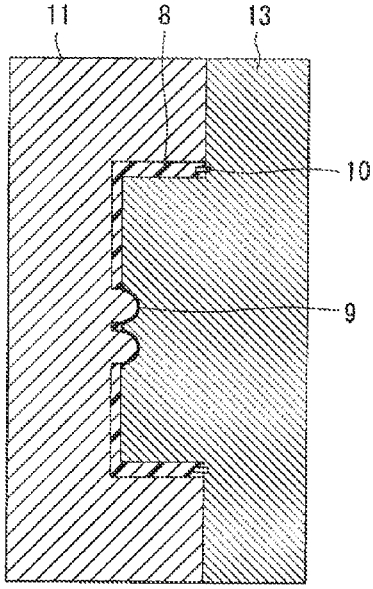
FIG. 7 is a cross-sectional view illustrating how metal molds for injection-molding internal pressure adjusting sections and a sealing member are arranged in a second molding step.

FIG. 7 is a cross-sectional view illustrating how metal molds for injection-molding the internal pressure adjusting sections 9 and the sealing member 10 are arranged in the second molding step. FIG. 7 illustrates a cross section identical to that of FIG. 6.

In the second molding step, the first metal mold 11 in the concave shape and the third metal mold 13 in a convex shape are combined with each other. The third metal mold 13 is shaped so that parts of the second metal mold 12, which parts correspond to the internal pressure molding sections 9 and the sealing member 10, are lacking. Therefore, cavities, which are formed by the first metal mold 11, the case base 8, and the third metal mold 13 thus combined, define (i) the shapes of the internal pressure adjusting sections 9 and (ii) the shape of the sealing member 10. The cavities are filled with heated thermoplastic polyester elastomer (S5). Polyester elastomer excels in thermal fusion bond property with respect to PBT. This causes the internal pressure adjusting sections 9 and the sealing member 10, each made from elastic polyester elastomer, to be molded so as to be integrated with the case base 8. This ultimately causes the case component 6 to be formed in which the case base 8 is integrated with the internal pressure adjusting sections 9 and the sealing member 10. Note that the internal pressure adjusting sections 9 and the sealing member 10 are located on a side of the case base 8 where the third metal mold 13 is arranged. That is, the internal pressure adjusting sections 9 and the sealing member 10 are provided at respective locations of the case component 6, which locations are visible from an identical direction. It is therefore possible to simultaneously mold the internal pressure adjusting sections 9 and the sealing member 10 by use of the third metal mold 13.

The second metal mold 12 is removed from the first metal mold 11, and the case component 6 is further removed from the first metal mold 11 (S6).

The above description has discussed a case where the internal pressure adjusting sections and the sealing member are molded so as to be integrated with the case component. Note, however, that the present invention is not limited to such a case. Alternatively, the internal pressure adjusting sections and the sealing member can be molded so as to be integrated with the cover component.

<Examples of Material>

Examples of the elastic body, from which the case component 6 is made, include hard resins such as amorphous resin, crystalline resin, polymer alloy, and thermosetting resin.

Examples of the amorphous resin include polycarbonate (PC) resin, styrene resin, acrylic resin (polymethylmethacrylate (PMMA)), polyphenylene ether resin (PPE, PPE/PS), and olefin resin. Examples of the styrene resin include acrylonitrile butadiene styrene (ABS) resin, acrylonitrile ethylene styrene (AES) resin, acrylonitrile styrene (AS) resin, general-purpose polystyrene (GPPS) resin, and high-impact polystyrene (HIPS) resin. Examples of the olefin resin include polyethylene (PE) resin, and polypropylene (PP) resin.

Examples of the crystalline resin include aromatic polyester resin, cellulose resin, biodegradable plastics, and polyamide resin. Examples of the aromatic polyester resin include polybutylene terephthalate (PBT), polyethylene terephthalate (PET), and amorphous copolymer polyester resin (PET-G). Examples of the cellulose resin include cellulose propionate, and cellulose acetate. Examples of the biodegradable plastics include polylactide (PLA), and poly (butylene succinate-co-L-lactate) (PBSL). Examples of the polyamide resin include PA6, PA66, PA12, and PA-.

Examples of the polymer alloy include PC/ABS resin, and PC/PBT resin.

Examples of the thermosetting resin include phenol resin, polyimide resin, and unsaturated polyester resin.

Examples of thermoplastic elastomer, from which the internal pressure adjusting sections 9 and the sealing member 10 are made, include polyester elastomer, styrene elastomer, olefin elastomer, vinyl chloride elastomer, polyurethane elastomer, and nylon elastomer.

A trigger switch according to one or more embodiments of the present invention is configured to include: a case member; a cover member; and an operation section which is used to carry out an operation, the case member and the cover member being combined with each other so as to constitute a waterproof case, the operation section being able to be operated so as to be displaced inward the waterproof case, an internal pressure of the waterproof case changing in accordance with the operation section being displaced, the case member including a case base which (i) is made from an inelastic body and (ii) does not deform in accordance with a change in internal pressure of the waterproof case, the case base having at least one (1) hole part, and the case base including at least one (1) deformation section which (i) seals the at least one hole part, (ii) is made from an elastic body, and (iii) deforms in accordance with the change in internal pressure of the waterproof case.

According to the configuration, since the case base is made from the inelastic body, the case base does not deform in accordance with the change in internal pressure of the waterproof case. In contrast, since the at least one deformation section is made from the elastic body, the at least one deformation section deforms in accordance with the change in internal pressure of the waterproof case. It is therefore possible to adjust the change in internal pressure of the waterproof case by causing the at least one deformation section to deform in accordance with the operation section being displaced. This prevents waterproofness from being deteriorated by the change in internal pressure of the waterproof case.

The trigger switch can be configured so that the case member includes a sealing member which is provided between the case base and the cover member, and the sealing member and the at least one deformation section are (i) made from identical elastic bodies and (ii) molded to be integrated with the case base at respective locations of the case member, which locations are visible from an identical direction.

According to the configuration, since the sealing member, which secures the waterproofness, and the at least one deformation section are molded to be integrated with the case base in the case member so as to be visible from the identical direction, it is possible to simultaneously mold the sealing member and the at least one deformation section on the case base. It is therefore possible to simplify a production process, as compared with, for example, a conventional case where a sealing member and a deformation section are individually formed. Further, according to the configuration, the case base, the sealing member, and the at least one deformation section are molded to be integrated with one another so as to constitute one (1) component. This makes it easy to assemble the waterproof case and to manage the components.

The trigger switch can be configured so that the at least one hole part includes a plurality of hole parts, and the at least one deformation section includes a plurality of deformation sections for the respective plurality of hole parts.

According to the configuration, the case member includes the plurality of deformation sections for the respective plurality of holes. It is therefore possible to reduce (i) the size of each of the plurality of holes and (ii) the size of each of the plurality of deformation sections. This makes it difficult to damage the deformation sections that are soft.

The trigger switch can be configured so that the case base is made from hard resin, and the at least one deformation section and the sealing member are each made from thermoplastic elastomer.

According to the configuration, the case base can secure an internal space of the waterproof case, and the at least one deformation section can adjust the internal pressure of the waterproof case.

The trigger switch can be configured so that the at least one hole part has a first diameter 14 of not more than 5 mm and a second diameter 15 of not less than 1 mm.

According to the configuration, the at least one deformation section is small in size. This makes it difficult to damage the at least one deformation section by a finger etc. It is therefore possible to maintain waterproofness.

The trigger switch can be configured so that the at least one deformation section is located more internally than an external surface of the waterproof case.

According to the configuration, the at least one deformation section is formed more internally than the external surface of the waterproof case. It is therefore possible to protect the at least one deformation section, which is soft, by the case base which is hard.

The case member of the trigger switch can be produced by (i) a first molding step of molding the case base having the at least one hole part by use of an inelastic material and (ii) a second molding step of molding, by use of an elastic material, (a) the sealing member, which is provided between the case member and the cover member that constitutes the waterproof case with the case member, and (b) the at least one deformation section which seals the at least one hole part, so that the sealing member and the at least one deformation section are integrated with the case base.

Since the case base is made from the inelastic body, the case base does not deform in accordance with the change in internal pressure of the waterproof case. In contrast, since the at least one deformation section is made from the elastic body, the at least one deformation section deforms in accordance with the change in internal pressure of the waterproof case. It is therefore possible to adjust the change in internal pressure of the waterproof case by causing the at least one deformation section to deform. This prevents waterproofness from being deteriorated by the change in internal pressure of the waterproof case. Further, according to the second molding step, it is possible to simultaneously mold, on the case base, (i) the sealing member which secures the waterproofness and (ii) the at least one deformation section.

The first molding step can be configured so that the case base is molded by use of a first metal mold and a second metal mold. The second molding step can be configured so that the sealing member and the at least one deformation section are molded by use of the first metal mold and a third metal mold.

According to the configurations, it is possible to (i) use the first metal mold in common in the first molding step and the second molding step and (ii) simultaneously mold the sealing member and the at least one deformation section depending on a difference between the second metal mold and the third metal mold. The sealing member and the at least one deformation section thus molded are located so as to be visible from an identical direction (in a direction from the second metal mold or the third metal mold toward the first metal mold).

The present invention is not limited to the description of the embodiments above, and can therefore be modified by a skilled person in the art within the scope of the claims. Namely, an embodiment derived from a proper combination of technical means modified as appropriate within the scope of the claims is encompassed in the technical scope of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

One or more embodiments of the present invention is applicable to a waterproof case.

REFERENCE SIGNS LIST

1: waterproof switch (trigger switch)
2: waterproof case
3: operation section
4: insertion section
5: seal boot
6: case component (case member)
7: cover component (cover member)
8: case base
9: internal pressure adjusting section (deformation section)
10: sealing member
11: first metal mold
12: second metal mold
13: third metal mold

The invention claimed is:

1. A trigger switch, comprising:

a case member;

a cover member; and an operation section that carries out an operation, wherein the case member and the cover member are combined with each other to form a waterproof case, wherein, when the operation section is operated by a user, the operation section is displaced toward the waterproof case, wherein the operation section includes an insertion section that is displaced inward the waterproof case when the operating section is displaced toward the waterproof case, the insertion section is covered by a seal boot with a bellow shape, wherein an internal pressure of the waterproof case changes in accordance with displacement of the operation section, wherein the case member comprises a case base that is made from an inelastic body, wherein the case base does not deform in accordance with a change in internal pressure of the waterproof case, wherein the case base comprises at least one hole part, wherein the case member comprises at least one deformation section that seals the at least one hole part, wherein the deformation section is made from an elastic body, wherein the deformation section deforms in accordance with the change in internal pressure of the waterproof case, wherein the at least one hole part comprises a plurality of hole parts, wherein the at least one deformation section comprises a plurality of deformation sections that are integral with each other so as to form a one-piece article for the respective plurality of hole parts, and wherein the at least one deformation section is located more internally than an external surface of the waterproof case.

2. The trigger switch as set forth in claim 1, wherein the case member comprises a sealing member provided between the case base and the cover member, wherein the sealing member and the at least one deformation section are made from identical elastic bodies, wherein the sealing member and the at least one deformation section are molded to be integrated with the case base at respective locations of the case member, and wherein the respective locations are visible from an identical direction.

3. The trigger switch as set forth in claim 2, wherein the case base is formed of hard resin, and wherein the at least one deformation section and the sealing member are each formed of thermoplastic elastomer.

4. The trigger switch as set forth in claim 1, wherein the at least one hole part has a first diameter of 5 mm or less, and a second diameter of not less than 1 mm and not longer than a length of the first diameter.

* * * * *